US005818174A

United States Patent [19]

Ohara et al.

[11] Patent Number: 5,818,174

[45] Date of Patent: Oct. 6, 1998

[54] NOISELESS DISPERSION ELECTROLUMINESCENT DEVICE AND SWITCH UNIT USING SAME

[75] Inventors: Masahiro Ohara; Masaru Kuwahara; Masayuki Yahagi, all of Osaka, Japan

[73] Assignee: Matsushita Electric Industrial Co., Ltd., Osaka, Japan

[21] Appl. No.: 808,645

[22] Filed: Feb. 28, 1997

[30] Foreign Application Priority Data

Mar. 1, 1996 [JP] Japan ..... 8-044526

[51] Int. Cl.[6] ..... G09G 3/12

[52] U.S. Cl. ..... 315/169.3; 257/98; 345/76; 362/84; 313/506; 313/509; 313/463

[58] Field of Search ..... 313/506, 509, 313/463; 362/84; 345/76; 315/169.3; 257/98, 72, 59; 359/528

[56] References Cited

U.S. PATENT DOCUMENTS 4,935,671 6/1990 Harada et al. ..... 315/169.3
5,006,838 4/1991 Fujioka et al. ..... 315/169.3 X
5,066,893 11/1991 Osada et al. ..... 315/169.3
5,325,107 6/1994 Ogawa et al. ..... 315/169.3 X
5,552,679 9/1996 Murasko ..... 315/169.3

*Primary Examiner*—Arnold Kinkead
*Attorney, Agent, or Firm*—Pollock, Vande Sande & Priddy

[57] ABSTRACT

A dispersion electroluminescent device and a switch unit using the same are disclosed. The dispersion electroluminescent device includes three electrodes: first and second electrode layers and a common electrode layer. The common electrode layer is disposed between the first and second electrode layers. An electroluminescent layer and a first dielectric layer are disposed between the first electrode layer and the common electrode layer. A second dielectric layer is disposed between the common electrode layer and the second electrode layer. A voltage source applies first and second ac or dc pulse voltages, which are 180° out of phase with each other, across the first electrode layer and the common electrode layer and across the common electrode layer and the second electrode layer, respectively, for canceling mechanical vibrations produced at the first and second dielectric layers by each other.

18 Claims, 6 Drawing Sheets

NOISELESS DISPERSION ELECTROLUMINESCENT DEVICE AND SWITCH UNIT USING SAME

BACKGROUND OF THE INVENTION

1. Technical Field

The present invention relates generally to a noiseless dispersion electroluminescent device which may be employed in illumination of an input unit of a variety of electronic equipment and a switch unit using the same.

2. Background of Related Art

FIG. 10 shows a conventional dispersion electroluminescent (EL) device. FIG. 11 shows a conventional illuminated switch unit using the EL device.

The EL device 1 in FIG. 10 includes a laminated multilayer having a thickness of approximately 0.3 mm consisting of an insulating substrate 2 made of a transparent resin film of approximately 100 $\mu$m thick, a transparent electrode layer 3, a luminescent layer 4, a dielectric layer 5, a back electrode layer 6, and an insulating layer 7.

In operation, when ac voltage or dc pulse voltage is applied across the transparent electrode layer 3 and the back electrode layer 6 through a driver (not shown), it will cause the light to be emitted outward through the insulating substance 2.

The switch unit 8, as shown in FIG. 11, includes a membrane switch 14, the EL device 1, a spacer 18, and a front sheet 17.

The membrane switch 14 includes an upper insulating plate 9, a spacer 13, and a lower insulating plate 11. The upper insulating plate 9 is made of a resin film having a thickness of approximately 100 $\mu$m and has printed on its back surface moving contacts 10. Similarly, the lower insulating plate 11 is made of a resin film and has printed on its front surface stationary contacts 12. The moving contacts 10 and the stationary contacts 12 are separated at a given gap through the spacer 13 secured between the upper and lower insulating plates 9 and 11 with adhesive.

The EL device 1 is disposed on the membrane switch 14. The front sheet 17 is made of a transparent resin film is disposed on the EL device 1 through the spacer 13 whose both surfaces are applied with adhesive. Push buttons 15 are made with a transparent or semi-transparent resin casting, are attached to the back surface of the front sheet 17 through an adhesive member 16.

In operation, the switch unit 8 is turned on by depressing the push button 15 through the front sheet 17 to press a portion of the EL device 1 so that the moving contacts 10 attached to the upper insulating plate 9 are brought into contact with the stationary contacts 12 attached to the lower insulating plate 11.

The above EL device 1 and the switching unit 8 however have the following drawback. When the ac voltage or dc pulse voltage is applied across the transparent electrode layer 3 and the back electrode layer 6 to activate the EL device 1, it will cause the EL device 1 to produce mechanical vibrations due to the piezoelectric effect of barium titanate ($BaTiO_3$) contained in the luminescent layer 4 and the dielectric layer 5, which are in turn, transmitted as noise through a structure in contact with the EL device 1 to an operator and which may interfere with radio communication, for example, in a portable telephone or a cordless telephone, leading to difficulty in hearing voice from a calling party.

The switching unit 8 also has the disadvantage that non-uniform light may emerge from the front sheet 17 of the EL device 1 due to partial deformation of the push button 15 and the spacer 18 when depressed to turn on the switching unit 8. A total thickness of the EL device 1 and the upper insulating plate 9 of the membrane switch 14 is as much as approximately 0.4 mm, therefore, much depression force is required to flex the EL device 1 and the upper insulating plate 9 to make contact between the moving contacts 10 and the stationary contacts 12. In order to avoid this drawback, increasing a flexible area, however, results in an increased overall size of the switch unit 8. Further, it is difficult to thin the switching unit 8 because of complexity of the structure.

SUMMARY OF THE INVENTION

It is therefore a principal object of the present invention to avoid the disadvantages of the prior art.

It is another object of the present invention to provide a noiseless and compact electroluminescent device designed to provide uniform illumination and a switching unit using the same.

According to one aspect of the present invention, there is a dispersion electroluminescent device which comprises: (a) an elastic transparent insulating substrate; (b) a transparent electrode layer formed on a back surface of the elastic transparent insulating substrate; (c) an electroluminescent layer formed on the transparent electrode layer; (d) a first dielectric layer formed on the electroluminescent layer; (e) a first back electrode layer formed on the first dielectric layer; (f) a first insulating layer formed on the first back electrode layer; (g) a second dielectric layer formed on the first insulating layer; (h) a second back electrode layer formed on the second dielectric layer; (i) a second insulating layer formed on the second back electrode layer; and (j) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage.

In the preferred mode of the invention, the first and second voltage are ac voltage. The first and second voltage may alternatively be dc pulse voltage.

An insulating layer is further disposed at one of the first locations between the transparent electrode layer and the electroluminescent layer, a second location between the electroluminescent layer and the first dielectric layer, and a third location between the first dielectric layer and the first back electrode layer.

According to a second aspect of the invention, there is provided a switch unit which comprises: (a) an electroluminescent device including (1) an elastic transparent insulating substrate, (2) a transparent electrode layer formed on the elastic transparent insulating substrate, (3) an electroluminescent layer formed on the transparent electrode layer, (4) a first dielectric layer formed on the electroluminescent layer, (5) a first back electrode layer formed on the first dielectric layer, (6) a first insulating layer formed on the first back electrode layer, (7) a second dielectric layer formed on the first insulating layer, (8) a second back electrode layer formed on the second dielectric layer, (9) a second insulating layer formed on the second back electrode layer, and (10) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage; (b) an insulating substrate;

(c) a stationary contact disposed on the insulating substrate; (d) a moving contact disposed at a given interval away from the stationary contact on a lower surface of the second insulating layer opposite to an upper surface on which the second back electrode layer is formed; and (e) a spacer disposed between the second insulating layer and the insulating substrate, the spacer having an opening to expose the moving contact to the stationary contact.

In the preferred mode of the invention, a protrusion is further provided which extends from the lower surface of the second insulating layer toward the insulating substrate. The protrusion has disposed thereon the moving contact so as to face the stationary contact.

The protrusion is formed with an insulating resin printed on the lower surface of the second insulating layer.

The protrusion may be formed with a portion of the electroluminescent device recessed toward the insulating substrate.

A diaphragm spring is further provided which is made of a transparent resin and disposed over the elastic transparent insulating substrate of the electroluminescent device. The diaphragm spring is curved outward so as to deform by depression to make contact between the stationary contact and the moving contact.

According to a third aspect of the invention, there is provided a switch unit which comprises: (a) an electroluminescent device including (1) an elastic transparent insulating substrate, (2) a transparent electrode layer formed on the elastic transparent insulating substrate, (3) an electroluminescent layer formed on the transparent electrode layer, (4) a first dielectric layer formed on the electroluminescent layer, (5) a first back electrode layer formed on the first dielectric layer, (6) a first insulating layer formed on the first back electrode layer, (7) a second dielectric layer formed on the first insulating layer, (8) a second back electrode layer formed on the second dielectric layer, (9) a second insulating layer formed on the second back electrode layer, and (10) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage; (b) an insulating substrate; (c) a spacer disposed between the second insulating layer and the insulating substrate, the spacer having an opening defined between the second insulating layer and the insulating substrate; (d) a first stationary contact disposed on the insulating substrate within the opening of the spacer; (e) a second stationary contact disposed on the insulating substrate at a given interval away from the stationary contact within the opening of the spacer; (f) a moving contact made of a metallic flexible curved plate, disposed within the opening of the spacer, the moving contact being connected to the first stationary contact, extending across the second stationary contact; and (g) a protrusion member formed on the second insulating layer of the electroluminescent device in engagement with a portion of the moving contact in alignment with the second stationary contact so that depressing the protrusion through the electroluminescent device makes contact between the first and second stationary contacts.

According to a fourth aspect of the invention, there is provided a dispersion electroluminescent device which comprises: (a) an elastic transparent insulating substrate; (b) a transparent electrode layer formed on a back surface of the elastic transparent insulating substrate; (c) an electroluminescent layer formed on the transparent electrode layer; (d) a first dielectric layer formed on the electroluminescent layer; (e) a first back electrode layer formed on the first dielectric layer; (f) a second dielectric layer formed on the first back electrode; (g) a second back electrode layer formed on the second dielectric layer; (h) an insulating layer formed on the second back electrode layer; and (i) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage.

In the preferred mode of the invention, an insulating layer is further disposed at one of a first location between the transparent electrode layer and the electroluminescent layer, a second location between the electroluminescent layer and the first dielectric layer, and a third location between the first dielectric layer and the first back electrode layer.

According to a fifth aspect of the invention, there is provided a switch unit which comprises: (a) a dispersion electroluminescent device including (1) an elastic transparent insulating substrate, (2) a transparent electrode layer formed on a back surface of the elastic transparent insulating substrate, (3) an electroluminescent layer formed on the transparent electrode layer, (4) a first dielectric layer formed on the electroluminescent layer, (5) a first back electrode layer formed on the first dielectric layer, (6) a second dielectric layer formed on the first back electrode, (7) a second back electrode layer formed on the second dielectric layer, (8) an insulating layer formed on the second back electrode layer, and (9) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage; (b) an insulating substrate; (c) a stationary contact disposed on the insulating substrate; (d) a moving contact disposed at a given interval away from the stationary contact on a lower surface of the second insulating layer opposite to an upper surface on which the second back electrode layer is formed; and (e) a spacer disposed between the insulating layer of the electroluminescent device and the insulating substrate, the spacer having an opening to expose the moving contact to the stationary contact.

In the preferred mode of the invention, a protrusion is further provided which extends from the lower surface of the insulating layer toward the insulating substrate. The protrusion has disposed thereon the moving contact so as to face the stationary contact.

The protrusion is formed with an insulating resin printed on the lower surface of the insulating layer.

The protrusion may alternatively be formed with a portion of the electroluminescent device recessed toward the insulating substrate.

A diaphragm spring is further provided which is made of a transparent resin and disposed over the elastic transparent insulating substrate of the electroluminescent device. The diaphragm spring is curved outward so as to deform by depression to make contact between the stationary contact and the moving contact.

According to the sixth aspect of the invention, there is provided a switch unit which comprises: (a) an electroluminescent device including (1) an elastic transparent insulating substrate, (2) a transparent electrode layer formed on a back surface of the elastic transparent insulating substrate, (3) an electroluminescent layer formed on the transparent electrode layer, (4) a first dielectric layer formed on the electroluminescent layer, (5) a first back electrode layer formed on the first dielectric layer, (6) a second dielectric layer formed on the first back electrode, (7) a second back electrode layer formed on the second dielectric layer, (8) an insulating layer formed on the second back electrode layer, and (9) a voltage source circuit applying a first voltage having a given frequency across the first back electrode layer and the transparent electrode layer and a second voltage having the given frequency across the first back electrode layer and the second back electrode layer, the first voltage being 180° out of phase with the second voltage; (b) an insulating substrate; (c) a spacer disposed between the insulating layer and the insulating substrate, the spacer having an opening defined between the insulating layer and the insulating substrate; (d) a first stationary contact disposed on the insulating substrate within the opening of the spacer; (e) a second stationary contact disposed on the insulating substrate at a given interval away from the first stationary contact within the opening of the spacer; (f) a moving contact made of a metallic flexible curved plate, disposed within the opening of the spacer, the moving contact being connected to the first stationary contact, extending across the second stationary contact; and (g) a protrusion member formed on the insulating layer of the electroluminescent device in engagement with a portion of the moving contact in alignment with the second stationary contact so that depressing the protrusion through the electroluminescent device makes contact between the first and second stationary contacts.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
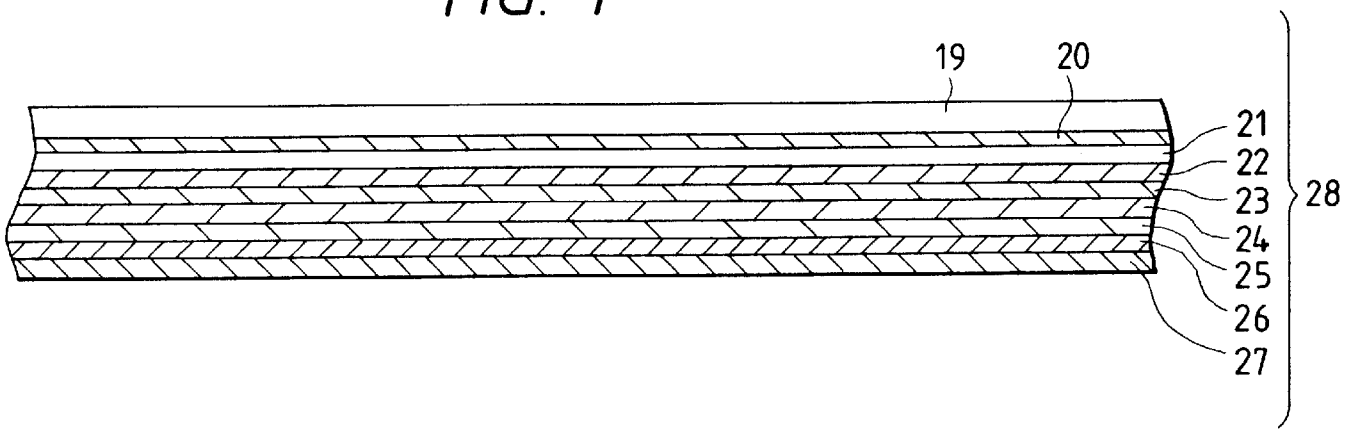
FIG. 1 is a cross-sectional view which shows an electroluminescent device according to the first embodiment of the invention.
Figure 2:
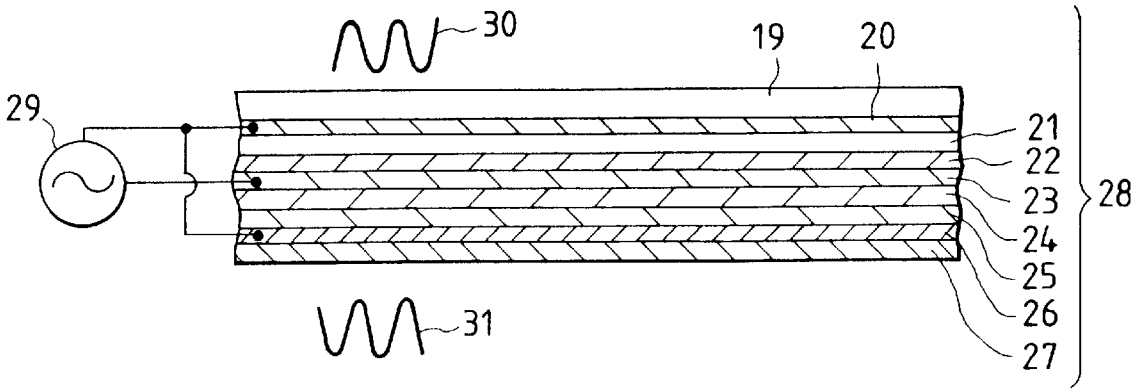
FIG. 2 is an explanatory view which shows an operation of the electroluminescent device of FIG. 1.

Referring now to the drawings, particularly to FIGS. 1 and 2, there is shown a dispersion electroluminescent (EL) device 28 according to the first embodiment of the invention.

The EL device 28 has a total thickness of approximately 0.3 mm and includes an upper insulating substrate 19, a transparent electrode layer 20, an electroluminescent layer 21, a first dielectric layer 22, a first back electrode layer 23, a first insulating layer 24, a second dielectric layer 25, a second back electrode layer 26, and a second insulating layer 27.

The upper insulating substrate 19 is made of an elastic transparent resin film having a thickness of approximately 80 $\mu$m. The transparent electrode layer 20 is printed on a lower surface of the upper insulating substrate 19 using a dispersion transparent paste made of a transparent insulating resin over which an indium oxide powder is distributed finely. The electroluminescent layer 21 is printed or formed on a lower surface of the transparent electrode layer 20 using a binder resin paste over which a zinc sulfide fluorescent powder is stirred and distributed. The first dielectric layer 22 is printed on the lower surface of the electroluminescent layer 21 using a binder resin paste over which a barium titanate powder is stirred and distributed. The first back electrode layer 23 is printed on a lower surface of the first dielectric layer 22 using a carbon resin paste. The first insulating layer 24 is printed on a lower surface of the first back electrode layer 23 using vinyl acetate-vinyl chloride copolymer insulating resist (hereinafter, referred to as an insulating resist). The second dielectric layer 25 is printed on a lower surface of the first insulating layer 24 using a binder resin paste over which a barium titanate powder is stirred and distributed. The second back electrode layer 26 is printed on a lower surface of the second dielectric layer 25 using a carbon resin paste. The second insulating layer 27 is printed on a lower surface of the second back electrode layer 26 using the insulating resist.

In operation, the first back electrode layer 23 serves as a common electrode. The application of ac voltages, which are 180° out of phase with each other, across the first back electrode layer 23 and the transparent electrode layer 20 and across the first back electrode layer 23 and the second back electrode layer 26 through a driver circuit 29 causes the EL device 28 to emit light through the upper insulating substrate 19.

The application of the ac voltages to the transparent electrode layer 20 and the second back electrode layer 26 will induce, as discussed in the introductory part of this application, the piezoelectric effect of barium titanate contained in the luminescent layer 21, the first dielectric layer 22, and the second dielectric layer 25. The piezoelectric effect in the luminescent layer 21 and the first dielectric layer 22 causes a mechanical vibration 30 to be produced. Similarly, the piezoelectric effect in the second dielectric layer 25 causes a mechanical vibration 31 to be produced. The mechanical vibration 30 is, as clearly shown in the drawing, 180° out of phase with the mechanical vibration 31, so that they are canceled by one another to reduce the level of sound pressure generated from the EL device 28. This realizes a noiseless EL device. Further, the EL device 28 is, as described above, 0.3 mm in thickness and provides good flexibility when used with a switch unit.

The above described vibration reduction effect of the EL device 28 may also be achieved by using dc pulse voltages instead of the ac voltages provided by the drive circuit 29.

Figure 3:
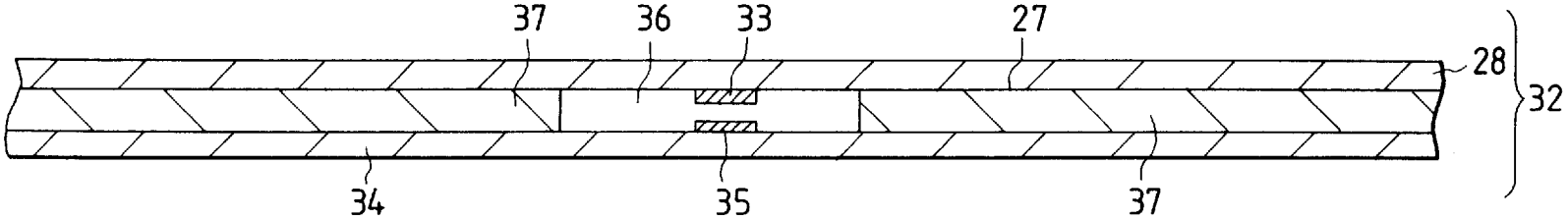
FIG. 3 is a cross-sectional view which shows a switch unit using the electroluminescent device of FIG. 1.

FIG. 3 shows an illuminated switch unit 32 according to the second embodiment which uses the EL device 28 as shown in FIGS. 1 and 2.

The switch unit 32 also includes a spacer 37, a moving contact 33, a stationary contact 35, and a lower insulating substrate 34. The moving contact 33 is printed on a lower surface of the second insulating layer 27 of the EL device 28 using a conductive paste such as a silver or carbon resin paste. The stationary contact 35 is printed on an upper surface of the lower insulating substrate 34. The spacer 37 is formed with a resin film having applied on its both surfaces adhesive and bonds the EL device 28 and the lower insulating substrate 34 together. The spacer 37 has an opening 36 which expose the moving contact 33 to the stationary contact 35 at a given interval away from each other.

In operation, depressing a portion of the upper surface of the EL device 28 opposed to the moving contact 33 causes the moving contact 33 to be brought into contact with the stationary contact 35 to establish electric communication therebetween.

The structure of the switch unit 32 eliminates the need for a member disturbing light transmission to be disposed on the EL device 28, thus resulting in uniform illumination through the EL device 28. Further, the EL device 28 is, as described above, 0.3 mm in thickness and provides good flexibility allowing the moving and stationary contacts 33 and 35 to make contact with a few ounces of pressure.

Figure 4:
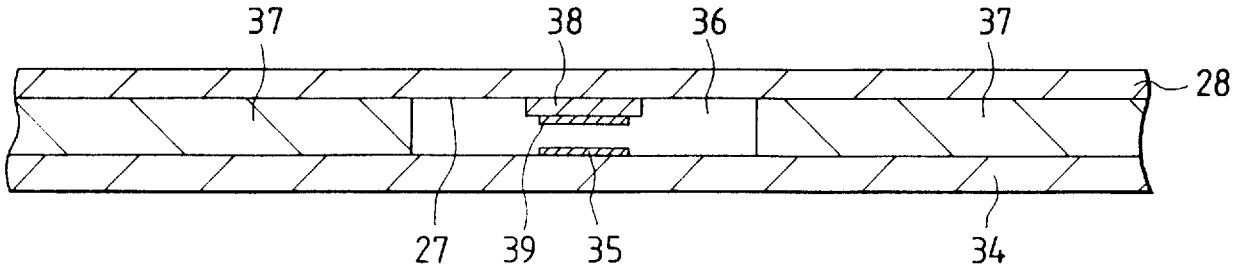
FIG. 4 is a cross-sectional view which shows a modification of a switch unit using the electroluminescent device of FIG. 1.

FIG. 4 shows a switch unit 32 according to the third embodiment of the invention. The same reference number as employed in the above embodiments refer to the same parts, and explanation thereof in detail will be omitted here.

The switch unit 32 of this embodiment includes a protrusion 38 which is made of epoxy resin and printed on the lower surface of the second insulating layer 27 of the EL device 28. The protrusion 38 has substantially a flat surface greater in area than the moving contact 39 on which the moving contact 38 is disposed at a given interval away from the stationary contact 35 formed on the upper surface of the lower insulating substrate 34.

Figure 11:
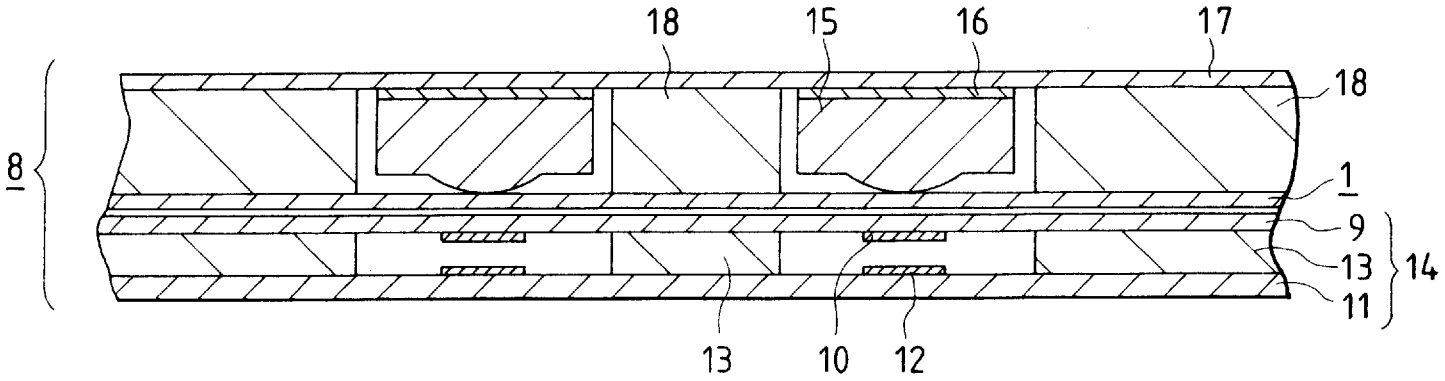
FIG. 11 PRIOR ART
FIG. 11 is a cross-sectional view which shows a conventional switch unit using the electroluminescent device of FIG. 10.

With these arrangements, easier adjustment of a stroke of the moving contact 39 in a switching operation than the second embodiment is achieved. The protrusion 38 performs substantially the same function as that of the push button 15 of the conventional switch unit shown in FIG. 11. Specifically, the protrusion 38 ensures electric communication between the moving contact 39 and the stationary contact 35 even when a depressed portion of the upper surface of the EL device 28 is slightly shifted from a correct position.

Figure 5:
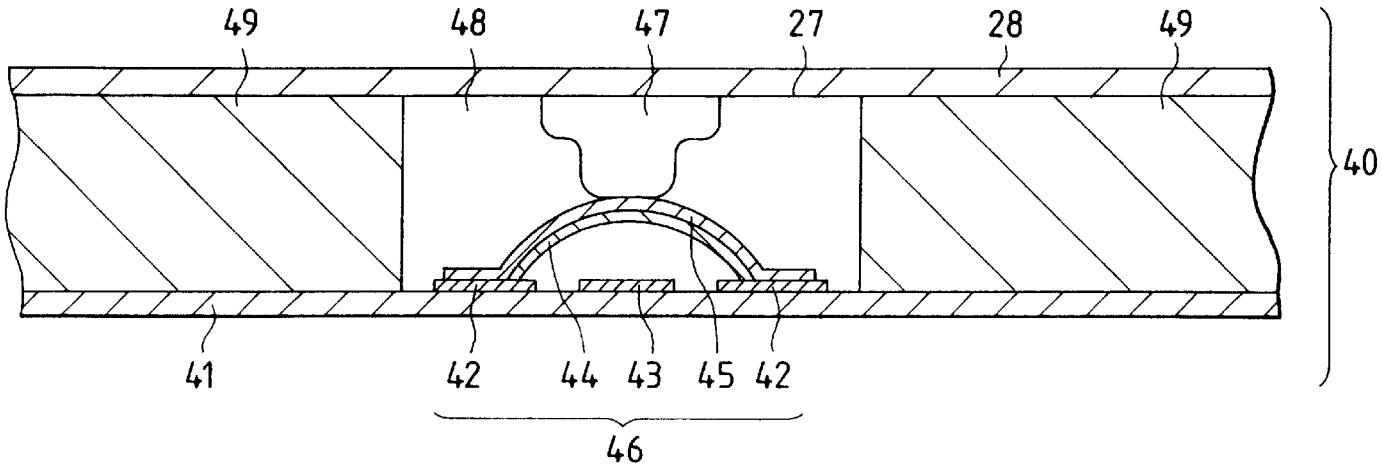
FIG. 5 is a cross-sectional view which shows a second modification of a switch unit using the electroluminescent device of FIG. 1.

FIG. 5 shows a switching unit 40 according to the fourth embodiment of the invention which uses the EL device 28 of the first embodiment.

The switching unit 40 also includes a spacer 49, a protrusion 47, a switch assembly 46, and a lower insulating substrate 41.

The spacer 49 is formed with a resin film having applied on its both surfaces adhesive and bonds the second insulating layer 27 of the EL device 28 and the lower insulating substrate 41 together. The spacer 49 has an opening 48 within which the switching assembly 46 is disposed.

The protrusion 47 is formed on the lower surface of the second insulating layer 27 of the EL device 28 using epoxy resin and functions as a push button.

The switching assembly 46 includes a stationary contact 42, a diaphragm moving contact 44, and a stationary contact 43. The stationary contact 42 is made of a conductive paper-base phenolic resin and formed on the lower insulating substrate 41 in a C-shape. The stationary contact 43 is made of a conductive disc member and disposed inside the stationary contact 42 on the lower insulating substrate 41. The diaphragm moving contact 44 is formed with a dome-shaped metallic spring made of phosphor bronze or stainless steel and projects upwards, as viewed in the drawing, in constant engagement with the protrusion 47 with both ends being attached to the stationary contact 42 using an adhesive tape 45.

In operation, depressing a portion of the upper surface of the EL device 28 opposed to the protrusion 47 flexes the diaphragm moving contact 44 downward, as viewed in the drawing, into contact with the stationary contact 43 to establish electric communication of the stationary contact 43 with the stationary contacts 42.

The structure of this embodiment gives an operator a moderate switching reaction against depression of the protrusion 47.

Figure 6:
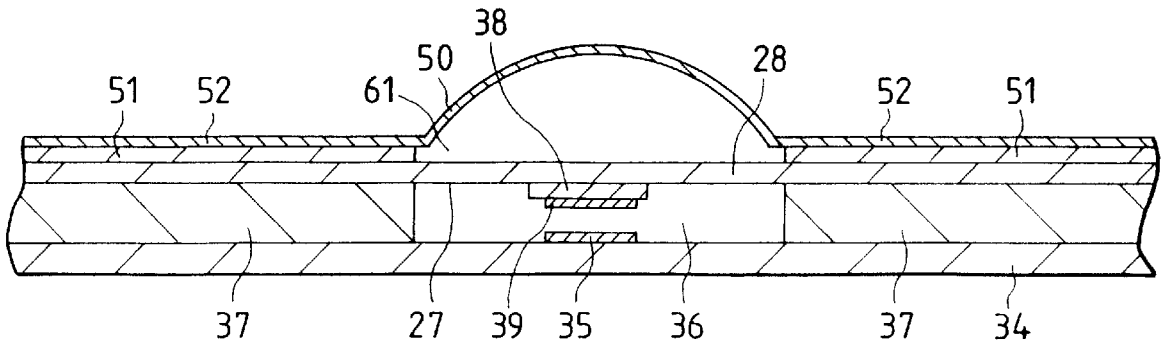
FIG. 6 is a cross-sectional view which shows a third modification of a switch unit using the electroluminescent device of FIG. 1.

FIG. 6 shows a switching unit according to the fifth embodiment of the invention which is a modification of the one shown in FIG. 4.

The switching unit of this embodiment includes a diaphragm spring 50 and a spacer 51. The diaphragm spring 50 leads from a flat plate 52 and is made by thermally drawing a 100 $\mu$m-thick transparent resin film into a dome-shape. The spacer 51 is made of a 100 $\mu$m-thick transparent resin film and has an opening 61. The spacer 51 has applied on its both surfaces adhesive and bonds the flat surface 52 and the EL device 20 together so that the top of the diaphragm spring 50 is aligned with the moving and stationary contacts 39 and 35.

The structure of this embodiment, as described above, has disposed on the EL device 28 the spacer 51 and the diaphragm spring 50, however, these are made of transparent films, respectively, and do not disturb illumination of the EL device 28.

Figure 7:
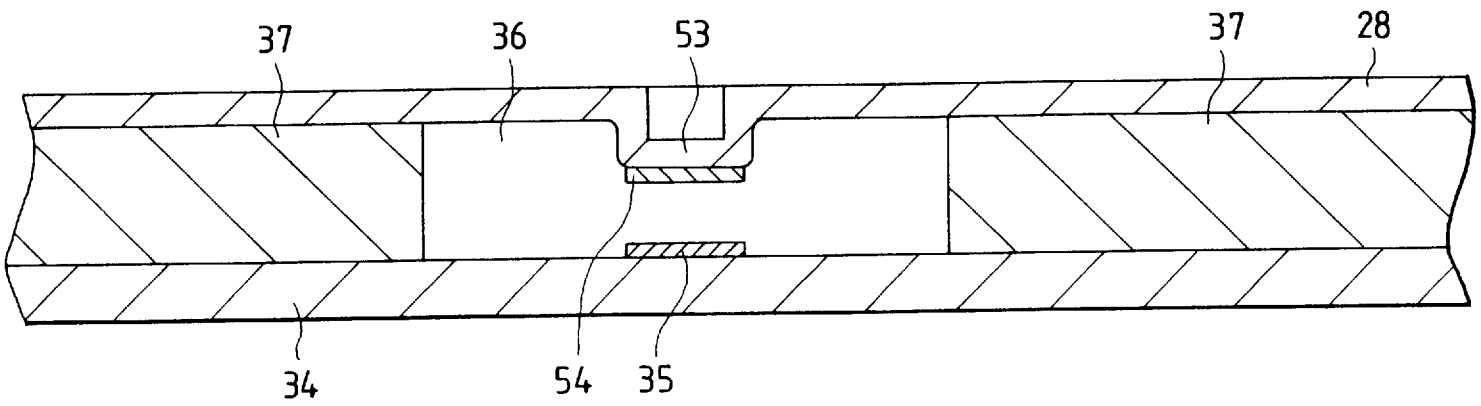
FIG. 7 is a cross-sectional view which shows a fourth modification of a switch unit using the electroluminescent device of FIG. 1.

FIG. 7 shows a switch unit according to the sixth embodiment of the invention which is a modification of the one shown in FIG. 4 different only in structure of the EL device 28.

The EL device 28 is, as clearly shown in the drawing, thermally pressed to form a recessed portion 53 projecting inward. The moving contact 54 is printed using a silver or carbon resin conductive paste on a flat bottom surface of the recessed portion 53 facing the stationary contact 35.

The structure of this embodiment, similar to the third embodiment, compensates for some degree of locational error in manual depression in a switching operation.

Figure 8:
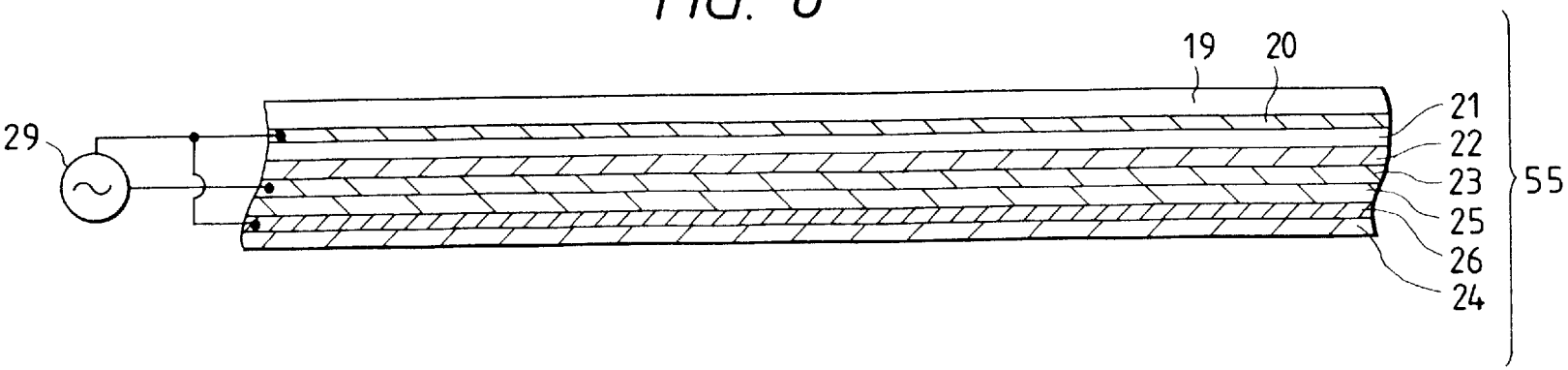
FIG. 8 is a cross-sectional view which shows a modification of an electroluminescent device.

FIG. 8 shows an EL device 55 according to the seventh embodiment which is different from the one shown in FIG. 1 only in that the first insulating layer 24 is disposed at the bottom of the EL device 55 instead of the second insulating layer 27.

Specifically, the second dielectric layer 25 is printed on the lower surface of the first back electrode layer 23. The second back electrode layer 26 is printed on the lower surface of the second dielectric layer 25. The first insulating layer 24 is printed on the lower surface of the second back electrode layer 26. The EL device 55 has a thickness of approximately 0.3 mm.

The EL device 55 is, as apparent from the above, has a smaller number of insulating layers than the EL device 28 of the first embodiment by one, thus resulting in a decrease in production cost.

The EL device 55 may be used in any of the switch units of the above embodiments.

Figure 9:
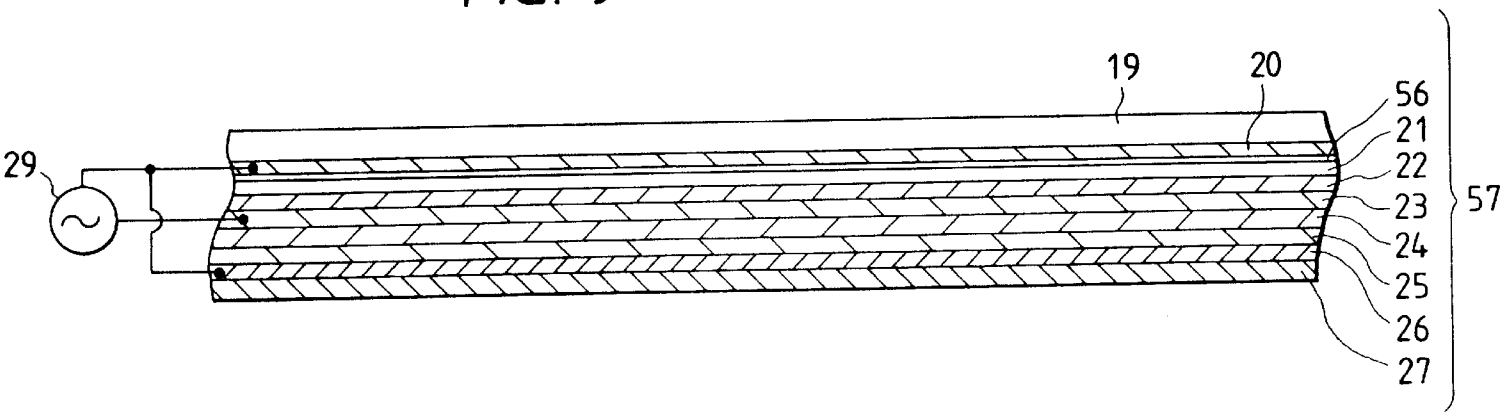
FIG. 9 is a cross-sectional view which shows a second modification of an electroluminescent device.
Figure 10:
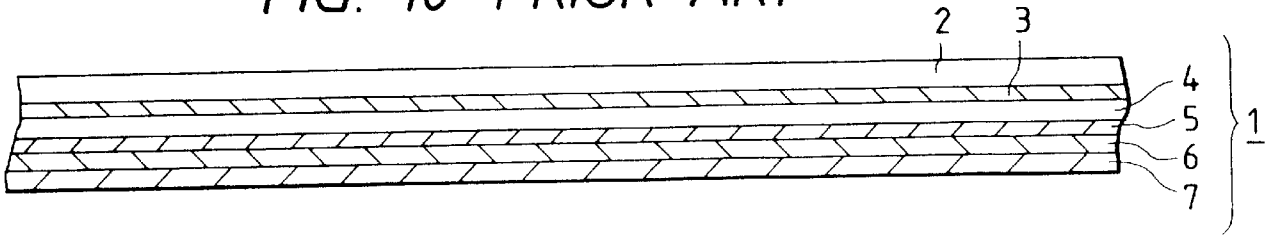
FIG. 10 PRIOR ART
FIG. 10 is a cross-sectional view which shows a conventional electroluminescent device.

FIG. 9 shows an EL device 57 according to the ninth embodiment of the invention which is different from the one shown in FIG. 1 only in that a transparent insulating layer 56 is disposed between the transparent electrode layer 20 and the electroluminescent layer 21.

The transparent insulating layer 56 is made of a binder resin paste over which a barium titanate powder is stirred and distributed.

The transparent insulating layer 56 may alternatively be disposed between the electroluminescent layer 21 and the first dielectric layer 22 or between the first dielectric layer 22 and the first back electrode layer 23. The EL device 57 has a thickness of approximately 0.3 mm and may be used in any of the switch units of the above embodiments. These arrangements may be used with the EL device as shown in FIG. 8.

The structure of this embodiment provides a high-withstand voltage that can be applied across the transparent electrode layer 20 and the first back electrode layer 23.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electroluminescent device comprising:

an elastic transparent insulating substrate;

a transparent electrode layer formed on a back surface of said elastic transparent insulating substrate;

an electroluminescent layer formed on said transparent electrode layer;

a first dielectric layer formed on said electroluminescent layer;

a first back electrode layer formed on said first dielectric layer;

a first insulating layer formed on said first back electrode layer;

a second dielectric layer formed on said first insulating layer;

a second back electrode layer formed on said second dielectric layer;

a second insulating layer formed on said second back electrode layer; and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage.

2. An electroluminescent device as set forth in claim 1, wherein the first and second voltage are an ac voltage.

3. An electroluminescent device as set forth in claim 1, wherein the first and second voltage are a dc pulse voltage.

4. An electroluminescent device as set forth in claim 1, further comprising an insulating layer disposed at one of a first location between said transparent electrode layer and said electroluminescent layer, a second location between said electroluminescent layer and said first dielectric layer, and a third location between said first dielectric layer and said first back electrode layer.

5. A switch unit comprising:

an electroluminescent device including an elastic transparent insulating substrate, a transparent electrode layer formed on said elastic transparent insulating substrate, an electroluminescent layer formed on said transparent electrode layer, a first dielectric layer formed on said electroluminescent layer, a first back electrode layer formed on said first dielectric layer, a first insulating layer formed on said first back electrode layer, a second dielectric layer formed on said first insulating layer, a second back electrode layer formed on said second dielectric layer, a second insulating layer formed on said second back electrode layer, and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage;

an insulating substrate;

a stationary contact disposed on said insulating substrate;

a moving contact disposed at a given interval away from said stationary contact on a lower surface of said second insulating layer opposite to an upper surface on which said second back electrode layer is formed; and a spacer disposed between said second insulating layer and said insulating substrate, said spacer having an opening to expose said moving contact to said stationary contact.

6. A switch unit as set forth in claim 5, further comprising a protrusion extending from the lower surface of said second insulating layer toward said insulating substrate, said protrusion having disposed thereon said moving contact so as to face said stationary contact.

7. A switch unit as set forth in claim 5, wherein said protrusion is formed with an insulating resin printed on the lower surface of said second insulating layer.

8. A switch unit as set forth in claim 5, wherein said protrusion is formed with a portion of said electroluminescent device recessed toward said insulating substrate.

9. A switch unit as set forth in claim 5, further comprising a diaphragm spring made of a transparent resin, disposed over said elastic transparent insulating substrate of said electroluminescent device, said diaphragm spring being curved outward so as to deform by depression to make contact between said stationary contact and said moving contact.

10. A switch unit comprising:

an electroluminescent device including an elastic transparent insulating substrate, a transparent electrode layer formed on said elastic transparent insulating substrate, an electroluminescent layer formed on said transparent electrode layer, a first dielectric layer formed on said electroluminescent layer, a first back electrode layer formed on said first dielectric layer, a first insulating layer formed on said first back electrode layer, a second dielectric layer formed on said first insulating layer, a second back electrode layer formed on said second dielectric layer, a second insulating layer formed on said second back electrode layer, and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage;

an insulating substrate;

a spacer disposed between said second insulating layer and said insulating substrate, said spacer having an opening defined between said second insulating layer and said insulating substrate;

a first stationary contact disposed on said insulating substrate within the opening of said spacer;

a second stationary contact disposed on said insulating substrate at a given interval away from said first stationary contact within the opening of said spacer;

a dome shaped metallic moving contact, disposed within the opening of said spacer, said moving contact being connected to said first stationary contact, extending across said second stationary contact; and a protrusion member formed on said second insulating layer of said electroluminescent device in engagement with a portion of said moving contact in alignment with said second stationary contact so that depressing said protrusion member through said electroluminescent device makes contact between said first and second stationary contacts.

11. An electroluminescent device comprising:

an elastic transparent insulating substrate;

a transparent electrode layer formed on a back surface of said elastic transparent insulating substrate;

an electroluminescent layer formed on said transparent electrode layer;

a first dielectric layer formed on said electroluminescent layer;

a first back electrode layer formed on said first dielectric layer;

a second dielectric layer formed on said first back electrode;

a second back electrode layer formed on said second dielectric layer;

an insulating layer formed on said second back electrode layer; and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage.

12. An electroluminescent device as set forth in claim 11, further comprising an insulating layer disposed at one of a first location between said transparent electrode layer and said electroluminescent layer, a second location between said electroluminescent layer and said first dielectric layer, and a third location between said first dielectric layer and said first back electrode layer.

13. A switch unit comprising:

an electroluminescent device including an elastic transparent insulating substrate, a transparent electrode layer formed on a back surface of said elastic transparent insulating substrate, an electroluminescent layer formed on said transparent electrode layer, a first dielectric layer formed on said electroluminescent layer, a first back electrode layer formed on said first dielectric layer, a second dielectric layer formed on said first back electrode, a second back electrode layer formed on said second dielectric layer, an insulating layer formed on said second back electrode layer, and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage;

an insulating substrate;

a stationary contact disposed on said insulating substrate;

a moving contact disposed at a given interval away from said stationary contact on a lower surface of said second insulating layer opposite to an upper surface on which said second back electrode layer is formed; and a spacer disposed between said insulating layer of said electroluminescent device and said insulating substrate, said spacer having an opening to expose said moving contact to said stationary contact.

14. A switch unit as set forth in claim 13, further comprising a protrusion extending from the lower surface of said insulating layer toward said insulating substrate, said protrusion having disposed thereon said moving contact so as to face said stationary contact.

15. A switch unit as set forth in claim 13, wherein said protrusion is formed with an insulating resin printed on the lower surface of said insulating layer.

16. A switch unit as set forth in claim 13, wherein said protrusion is formed with a portion of said electroluminescent device recessed toward said insulating substrate.

17. A switch unit as set forth in claim 13, further comprising a diaphragm spring made of a transparent resin, disposed over said elastic transparent insulating substrate of said electroluminescent device, said diaphragm spring being curved outward so as to deform by depression to make contact between said stationary contact and said moving contact.

18. A switch unit comprising:

an electroluminescent device including an elastic transparent insulating substrate, a transparent electrode layer formed on a back surface of said elastic transparent insulating substrate, an electroluminescent layer formed on said transparent electrode layer, a first dielectric layer formed on said electroluminescent layer, a first back electrode layer formed on said first dielectric layer, a second dielectric layer formed on said first back electrode, a second back electrode layer formed on said second dielectric layer, an insulating layer formed on said second back electrode layer, and a voltage source circuit applying a first voltage having a given frequency across said first back electrode layer and said transparent electrode layer and a second voltage having the given frequency across said first back electrode layer and said second back electrode layer, the first voltage being 180° out of phase with the second voltage;

an insulating substrate;

a spacer disposed between said insulating layer and said insulating substrate, said spacer having an opening defined between said insulating layer and said insulating substrate;

a first stationary contact disposed on said insulating substrate within the opening of said spacer;

a second stationary contact disposed on said insulating substrate at a given interval away from said first stationary contact within the opening of said spacer;

a dome shaped metallic moving contact, disposed within the opening of said spacer, said moving contact being connected to said first stationary contact, extending across said second stationary contact; and a protrusion member formed on said insulating layer of said electroluminescent device in engagement with a portion of said moving contact in alignment with said second stationary contact so that depressing said protrusion member through said electroluminescent device makes contact between said first and second stationary contacts.

* * * * *